US006233970B1

(12) United States Patent
Smith, IV et al.

(10) Patent No.: US 6,233,970 B1
(45) Date of Patent: May 22, 2001

(54) PROCESS FOR DELIVERY OF OXYGEN AT A VARIABLE RATE

(75) Inventors: Oliver Jacob Smith, IV, New Tripoli; Donn Michael Herron, Fogelsville, both of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/437,896

(22) Filed: Nov. 9, 1999

(51) Int. Cl.[7] ..... F25J 3/00
(52) U.S. Cl. ..... 62/646; 654/656
(58) Field of Search ..... 62/646, 654, 656

(56) References Cited

U.S. PATENT DOCUMENTS

| | | | | |
|---|---|---|---|---|
| 4,853,015 | * | 8/1989 | Yoshino | 62/656 |
| 5,082,482 | | 1/1992 | Darredeau | 62/24 |
| 5,084,081 | | 1/1992 | Rohde | 62/37 |
| 5,265,429 | | 11/1993 | Dray | 62/41 |
| 5,505,051 | * | 4/1996 | Darredeau et al. | 62/656 |
| 5,526,647 | | 6/1996 | Grenier | 62/654 |

* cited by examiner

*Primary Examiner*—Ronald Capossela
(74) *Attorney, Agent, or Firm*—Willard Jones, II

(57) ABSTRACT

A process delivers oxygen at a variable flow rate from a distillation system. The process uses a higher pressure column and a lower pressure column. The effects of oxygen product rate fluctuations on the distillation system are reduced by maintaining essentially constant flow rates within the columns. The process also utilizes a first storage vessel and a second storage vessel and includes the following features: liquid oxygen is withdrawn at a substantially constant rate from the distillation column system and at least a portion of the withdrawn liquid oxygen is directed to the second storage vessel; liquid oxygen is withdrawn from the second storage vessel at a variable rate and vaporized in a main heat exchanger against an incoming variable flow rate of air which is condensed to form a liquid air stream and then sent directly to the distillation column system; and liquid oxygen is withdrawn from the distillation column system from the same location where at least one of the liquid air streams is fed to the distillation column system, and at least a portion of the liquid air is directed to the first storage vessel during periods of higher than average oxygen delivery rate.

17 Claims, 7 Drawing Sheets

PROCESS FOR DELIVERY OF OXYGEN AT A VARIABLE RATE

CROSS-REFERENCE TO RELATED APPLICATIONS

Not Applicable.

STATEMENT REGARDING FEDERALLY SPONSORED RESEARCH FOR DEVELOPMENT

Not Applicable.

BACKGROUND OF THE INVENTION

The present invention pertains to the field of cryogenic air separation, and in particular to a process for the delivery of oxygen at a variable flow rate from a distillation column system.

The ability to supply oxygen to a customer at widely varying rates has always been particularly important in some industry sectors such as steel production and integrated gasification combined cycles (IGCC) for electricity generation. The importance of this ability has grown recently for other sectors due to the trend in industrial gas producers taking advantage of time-of-day and other types of contracts to reduce their operating costs. In such situations, the response time of a cryogenic air separation unit can be much slower than that necessary to meet variable demand rates. This is particularly true when oxygen is produced from a double column distillation configuration. It is thus advantageous to isolate the distillation columns from disturbances by withdrawing oxygen at a constant rate which corresponds to the time-average production. In such an event, any excess oxygen product must be stored temporarily during periods when the customer demand is reduced relative to the time-average production and oxygen product must be withdrawn from storage when the customer demand exceeds the time-average production.

The prior art has suggested storing oxygen as a compressed gas in high pressure storage bottles. This technique is useful when the variations in customer demands are of high frequency and/or of short duration. However, due to the high pressures and volumes necessary to store product in the gas phase, it generally is much more economical to store product in the liquid phase.

Storing product in the liquid phase, however, also has at least one disadvantage. Since the product is required in the vapor phase by the customer, the liquid must be vaporized in accordance with variable demand rates. Since oxygen often is vaporized by heat exchange with an incoming warm stream, such as air, the variable rate of oxygen vaporization produces a variable rate of liquid feed to the distillation columns. Such variations constitute disturbances which can affect oxygen product purity.

According to the prior art, by providing storage for the incoming liquefied feed and storage for the outgoing liquid oxygen product, the flow rates of the liquefied feed and the products of the columns can be held essentially constant by allowing the inventories in the feed and the product storage tanks to vary. U.S. Pat. No. 5,082,482 (Darredeau) teaches transferring all of the liquefied air to a storage vessel, withdrawing the liquid air at a constant rate from the storage vessel, and transferring the liquid air to the distillation system. The liquid air storage operates at a pressure slightly greater than the pressure of the distillation system.

U.S. Pat. No. 5,265,429 (Dray) teaches a variation on Darredeau whereby only a portion of the liquid air is directed to storage during periods of high oxygen production, and liquid air is transferred from storage to the main liquid air circuit during periods of low oxygen production. In either event, the storage vessel must operate at a pressure greater than that of the distillation system. U.S. Pat. No. 5,526,647 (Grenier) teaches the use of a storage vessel for liquid air that is maintained at pressures substantially greater than the pressure of the distillation system.

All of the prior art patents teach methods wherein both the inventories of the incoming liquefied air and the outgoing liquid oxygen are varied so as to allow the feed flow rate to, and the product flow rate from, the distillation columns to remain essentially constant. These patents also teach that the liquid air fed to either the higher pressure column, lower pressure column, or both columns is extracted from the liquid air storage vessel.

The disadvantages of storing the liquid air at pressures greater than that of the distillation system depend on the degree to which the pressure is greater. The pressure of the main liquid air stream often is 200 psia to 1200 psia. If the liquid air storage pressure is maintained at that of the incoming liquid air, the storage vessel must be capable of withstanding high pressure and consequently is expensive to construct. If the liquid air storage pressure is less than that of the main air, then the fluid entering the storage vessel may produce vapor upon pressure reduction. This flash vapor must be routed to the distillation system at a variable rate, since the liquid air flow sent to the storage vessel is variable. Since the variation in vapor flow resulting from the liquid air pressure reduction is small compared to the vapor flows in the distillation system, the resulting impact on product purity can be minimized through appropriate control strategy. However, the variation in vapor flow at the liquid air storage vessel itself can be large in relative terms. This makes it difficult to control storage pressure which in turn impacts the pressure or flow of liquid air into storage. Thus, storing liquid air at a pressure intermediate of the main liquid air and the distillation system does not completely eliminate disturbances.

U.S. Pat. No. 5,084,081 (Rohde) teaches a method of withdrawing and storing a nitrogen-rich liquid and oxygen-enriched bottoms from the higher pressure column at a variable rate and introducing streams of the nitrogen-rich liquid and the oxygen-enriched bottoms at a constant rate to the lower pressure column. This maintains constant rates in the lower pressure column but allows flow variations in the higher pressure column. The system taught by this patent requires three storage vessels—one for liquid nitrogen, one for liquid oxygen, and one for liquid oxygen-enriched bottoms.

It is desired to have a more operable process for the delivery of oxygen at variable flow rates.

It also is desired to have a process for the delivery of oxygen at a variable flow rate which overcomes the difficulties and disadvantages of the prior art to provide better and more advantageous results.

BRIEF SUMMARY OF THE INVENTION

The present invention is a process for the delivery of oxygen at variable flow rates from a distillation system.

The first embodiment of the invention is a process for delivering oxygen at a variable flow rate. The process, which has an average oxygen delivery rate, uses a distillation system having at least a first distillation column operating at a first pressure and a second distillation column operating at a second pressure. Each distillation column has a top and a bottom. The process includes multiple steps. The first is to feed a stream of liquid comprising air components into the first distillation column, wherein at least a portion of the stream of liquid mixes with a liquid descending in the first distillation column, thereby forming a liquid mixture. The second step is to transfer at least a portion of the liquid mixture from a location above the bottom of the first distillation column to a first storage vessel at least during periods of greater than the average oxygen delivery rate. The third step is to withdraw a stream of liquid oxygen from the distillation system. The fourth step is to transfer at least a portion of the withdrawn stream of liquid oxygen to a second storage vessel at least during periods of less than the average oxygen delivery rate. The fifth step is to remove at least a portion of the liquid oxygen from the second storage vessel at least during periods of greater than the average oxygen delivery rate.

There are several variations of the first embodiment. For example, in one variation, the stream of liquid comprising air components has the composition of air. In another variation, the first pressure is higher than the second pressure; and in another variation, the first pressure is lower than the second pressure.

There also are other variations of the first embodiment. In one such variation, the stream of liquid oxygen is withdrawn at a substantially constant flow rate from one of the first or second distillation columns; and the at least a portion of the liquid oxygen is removed at a variable flow rate from the second storage vessel. In another variation, the at least a portion of the liquid mixture transferred from the first distillation column is withdrawn at substantially the same location within the first distillation column where the stream of liquid is fed into the first distillation column.

A second embodiment of the invention includes the same multiple steps of the first embodiment, but includes two additional steps. The first additional step is to increase the pressure of the at least a portion of the liquid oxygen removed from the second storage vessel. The second additional step is to vaporize the at least a portion of the liquid oxygen having an increased pressure to form a gaseous oxygen product stream.

A third embodiment of the invention is similar to the first embodiment but includes three additional steps. The first additional step is withdraw a stream of liquid nitrogen from the first distillation column. The second additional step is to transfer at least a portion of the stream of liquid nitrogen to a third storage vessel. The third additional step is to withdraw at least a portion of the liquid nitrogen from the third storage vessel.

In one variation of the third embodiment, the stream of liquid nitrogen is withdrawn at a substantially constant flow rate from the first distillation column; and the at least a portion of the liquid nitrogen is withdrawn at a variable flow rate from the third storage vessel.

A fourth embodiment of the invention is similar to the above-described variation of the third embodiment, but includes two additional steps. The first additional step is to increase the pressure of the at least a portion of the liquid nitrogen removed from the third storage vessel. The second additional step is to vaporize the at least a portion of the liquid nitrogen having an increased pressure to form a gaseous nitrogen product stream.

A fifth embodiment of the invention is a process for delivering oxygen at a variable flow rate. The process, which has an average oxygen delivery rate, uses a distillation system having at least a first distillation column operating at a first pressure and a second distillation column operating at a second pressure lower than the first pressure. Each distillation column has a top and a bottom. The process includes multiple steps. The first step is to feed a first stream of liquid air into the first distillation column, wherein at least a portion of the first stream of liquid air mixes with a liquid descending in the first distillation column, thereby forming a liquid mixture. The second step is to feed a second stream of liquid air into the second distillation column. The third step is to transfer at least a portion of the liquid mixture from a location above the bottom of the first distillation column to a first storage vessel at least during periods of greater than the average oxygen delivery rate. The fourth step is to withdraw a stream of liquid oxygen from the distillation system. The fifth step is to transfer at least a portion of the withdrawn stream of liquid oxygen to a second vessel at least during periods of less than the average oxygen delivery rate. The sixth step is to remove at least a portion of the liquid oxygen from the second storage vessel at least during periods of greater than the average oxygen delivery rate.

In one variation of the fifth embodiment, the second stream of liquid air is fed into the second distillation column at a first variable rate; the at least a portion of the liquid mixture is fed from the first storage vessel into the second distillation column at a second variable flow rate; and a sum of the first variable flow rate and the second variable flow rate remains substantially constant over time.

A sixth embodiment of the invention is a process for delivering oxygen at a variable flow rate. The process, which has an average oxygen delivery rate, uses a distillation system having at least a first distillation column operating at a first pressure and second distillation column operating at a second pressure higher than the first pressure. Each distillation column has a top and a bottom. The process includes multiple steps. The first step is to feed a stream of liquid air into the second distillation column, wherein at least a portion of the stream of liquid air mixes with a first liquid descending in the second distillation column, thereby forming a first liquid mixture. The second step is to transfer at least a portion of the first liquid mixture from the second distillation column to the first distillation column, wherein at least a portion of the first liquid mixture mixes with a second liquid descending in the first distillation column, thereby forming a second liquid mixture. The third step is to transfer at least a portion of the second liquid mixture from a location above the bottom of the first distillation column to a first storage vessel at least during periods of greater than the average oxygen delivery rate. The fourth step is to withdraw a stream of liquid oxygen from the distillation system. The fifth step is to transfer at least a portion of the withdrawn stream of liquid oxygen to a second storage vessel at least during periods of less than the average oxygen delivery rate. The sixth step is to remove at least a portion of the liquid oxygen from the second storage vessel at least during periods of greater than the average oxygen delivery rate.

A seventh embodiment of the invention is a process for delivering oxygen at a variable rate. The process, which has an average oxygen delivery rate, uses a distillation system having at least a first distillation column operating at a first pressure and a second distillation column operating at a second pressure higher than the first pressure. Each distillation column has a top and a bottom. The process includes multiple steps. The first step is to feed a stream of liquid air into the first distillation column, wherein at least a portion of the stream of liquid air mixes with a liquid descending in the first distillation column, thereby forming a liquid mixture. The second step is to feed a second stream of liquid air into the second distillation column. The third step is to transfer at least a portion of the liquid mixture from a location above the bottom of the first distillation column to a first storage vessel at least during periods of greater than the average oxygen delivery rate. The fourth step is to withdraw a stream of liquid oxygen from the distillation system. The fifth step is to transfer at least a portion of the withdrawn stream of liquid oxygen to a second storage vessel at least during periods of less than the average oxygen delivery rate. The sixth step is to remove at least a portion of the liquid oxygen from the second storage vessel at least during periods of greater than the average oxygen delivery rate.

An eighth embodiment of the invention is a process for delivering oxygen at a variable flow rate. The process, which has an average oxygen delivery rate, uses a distillation system having at least a first distillation column, operating at a first pressure and a second distillation column operating at a second pressure higher than the first pressure. Each distillation column has a top and a bottom. The process includes multiple steps. The first step is to feed stream of liquid air into the first distillation column, wherein at least a portion of the stream of liquid air mixes with a liquid descending in the first distillation column, thereby forming a liquid mixture. The second step is to transfer at least a portion of the liquid mixture from a location above the bottom of the first distillation column to a first storage vessel at least during periods of greater than the average oxygen delivery rate. The third step is to withdraw the at least a portion of the liquid mixture from the first storage vessel. The fourth step is to transfer the at least a portion of the liquid mixture withdrawn from the first storage vessel into the second distillation column at a substantially constant flow rate. The fifth step is to withdraw a stream of liquid oxygen from the distillation system. The sixth step is to transfer at least a portion of the withdrawn stream of liquid oxygen to a second storage vessel at least during periods of less than the average oxygen delivery rate. The seventh step is to remove at least a portion of the liquid oxygen from the second storage vessel at least during periods of greater than the average oxygen delivery rate.

Another aspect of the present invention is a cryogenic air separation unit using any of the processes of the present invention. For example, one embodiment is a cryogenic air separation unit using a process as in the first embodiment, and another embodiment is a cryogenic air separation unit using a process as in the third embodiment.

BRIEF DESCRIPTION OF THE DRAWINGS

The invention will be described by way of example with reference to the accompanying drawings in which.

DETAILED DESCRIPTION OF THE INVENTION

Figure 1:
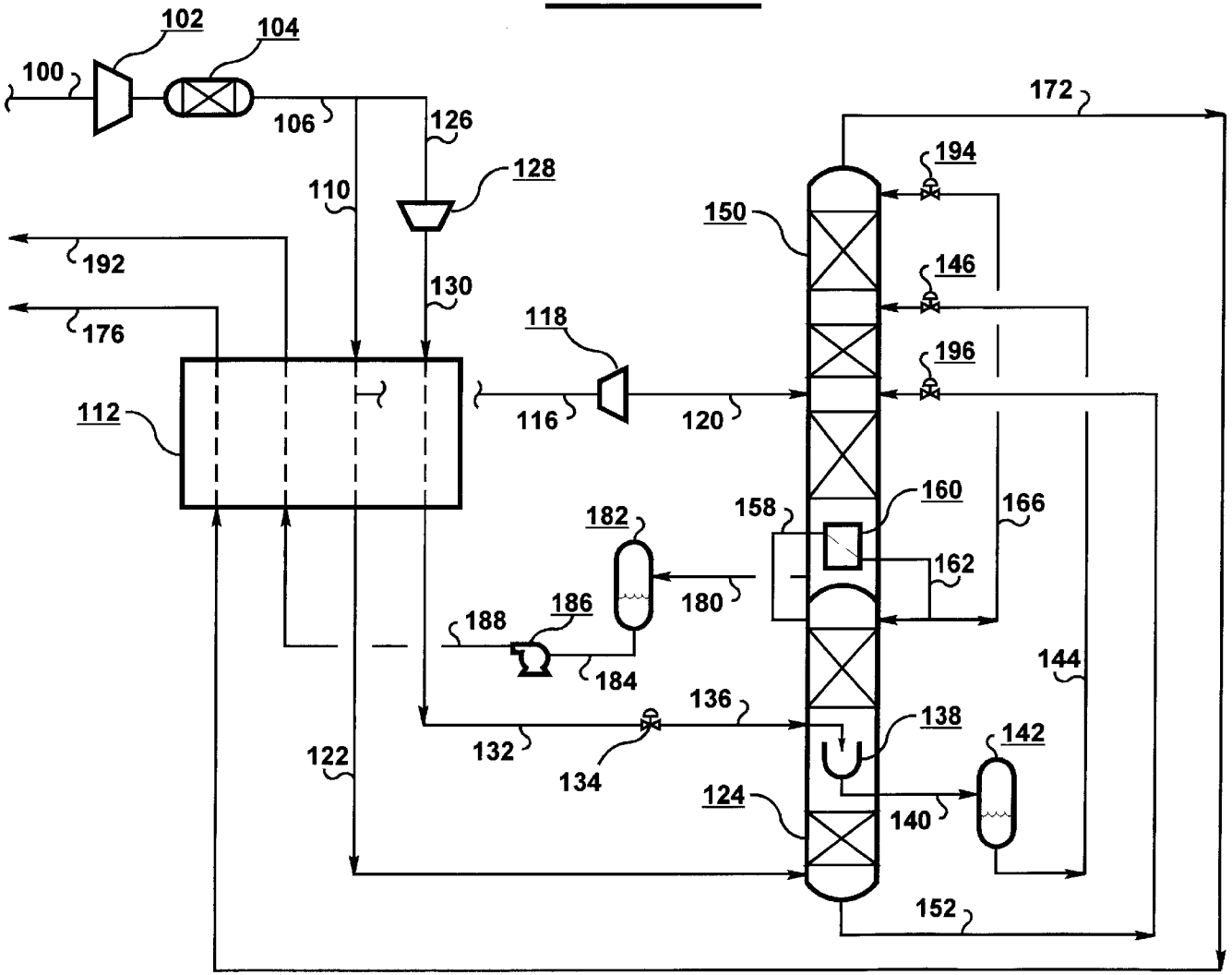
FIG. 1 is a schematic diagram of an embodiment of the present invention.

The present invention proposes a cryogenic air separation process, various embodiments of which are illustrated in FIGS. 1–7. The process uses a distillation column system comprising at least a higher pressure column 124 and a lower pressure column 150, wherein the effects of oxygen product flow rate fluctuations on the distillation column system are reduced by maintaining essentially constant flow rates within the columns. The process also utilizes a first storage vessel 142 and a second storage vessel 182 and includes the following features in one or more embodiments: liquid oxygen is withdrawn at a substantially constant rate from the distillation column system and at least a portion of the withdrawn liquid oxygen is directed to the second storage vessel 182; liquid oxygen is withdrawn from the second storage vessel at a variable rate and vaporized in a main heat exchanger 112 against an incoming variable flow rate of air which is condensed to form a liquid air stream and then sent directly to the distillation column system; and a liquid stream is withdrawn from the distillation column system from the same location where at least one of the liquid air streams is fed to the distillation column system, and at least a portion of the liquid air is directed to a first storage vessel 142 during periods of higher than average oxygen delivery rate.

One embodiment of the invention is shown in FIG. 1. Feed air 100 is compressed in compressor 102 then cleaned and dried in filter/dryer 104 to form pressurized feed stream 106, which is divided into two portions—stream 110 and stream 126. Stream 110 is partially cooled in main heat exchanger 112. A fraction of the partially cooled stream 110 is drawn off as stream 116, and the remainder, stream 122, is further cooled to a temperature near dew point and introduced to the bottom of higher pressure column 124. The stream 116 is turbo-expanded in turbine/expander 118 to produce stream 120, which is fed to the lower pressure column 150. Stream 126 is further compressed in compressor 128 to produce stream 130, which is cooled and condensed in the main heat exchanger to form stream 132. Stream 132 is reduced in pressure by valve 134 to form stream 136, which is fed to the higher pressure column.

The higher pressure column 124 produces a nitrogen-enriched overhead 158 and an oxygen-enriched bottoms 152. The nitrogen-enriched overhead is condensed in reboiler-condenser 160. A portion of the condensate 162 is returned to the higher pressure column as reflux and the remainder 166, after being reduced in pressure by valve 194, is sent to the lower pressure column 150 as reflux. The oxygen-enriched bottoms 152, after being reduced in pressure by valve 196, is sent to the lower pressure column as a feed.

A liquid is withdrawn as stream 140 from a collection pot 138 located in the higher pressure column 124. The collection pot receives liquid descending from a distillation section above it plus the liquid feed stream 136. Consequently, the withdrawn liquid stream 140 is taken from the same location in the higher pressure column where feed stream 136 enters that column. Withdrawn liquid stream 140 is transferred to a first storage vessel 142. A liquid stream 144 is withdrawn from the first storage vessel and, after being reduced in pressure by valve 146, stream 144 is fed to the lower pressure column 150 as a feed.

The lower pressure column 150 produces a nitrogen-rich vapor 172 from the top of the column. The nitrogen-rich vapor is warmed in the main heat exchanger 112 and discharged as stream 176. Stream 176 may be a desirable product stream or may be a waste from the process. Liquid oxygen is withdrawn from the bottom of the lower pressure column as stream 180 and transferred to the second storage vessel 182. The liquid oxygen is withdrawn from the second storage vessel 182 as stream 184, pumped (if required) to a desired pressure in pump 186 to form stream 188, and then vaporized and warmed in the main heat exchanger to form a gaseous oxygen product stream 192.

It is desired to maintain essentially constant vapor and liquid traffic in the higher pressure column 124 and the lower pressure column 150. This requires a constant flow of stream 180 from the bottom of the lower pressure column as well as a constant flow of vapor feed 122 to the higher pressure column. The constant flow of stream 180 corresponds to the average production rate from the process.

During periods of greater-than-average oxygen delivery, the flow of stream 184 leaving the second storage vessel 182 exceeds the flow of stream 180 entering the second storage vessel, and thus the level in the second storage vessel falls. In order to vaporize the greater-than-average oxygen flow, it is necessary to increase the flow of stream 130 and, consequently, increase the flows of streams 132 and 136. Since more liquid is entering the higher pressure column 124 as stream 136, it is necessary to increase the flow of stream 140 to the first storage vessel 142. This is done to maintain an essentially constant flow of liquid in the higher pressure column. Since it is desirable to maintain constant liquid flows to the lower pressure column 150 as well, it is necessary to maintain the liquid withdrawal rate from the first storage vessel 142 at a time average value. Consequently, during a period of greater-than-average oxygen delivery, the flow of stream 140 will be greater than the flow of stream 144, and thus the level in the first storage vessel 142 rises.

During periods of less-than-average oxygen delivery, the flow of stream 180 from the bottom of the lower pressure column 150 exceeds the flow of stream 184, and thus the level in the second storage vessel 182 rises. The flow of stream 140 from the higher pressure column 124 is less than the liquid flow of stream 144 to the lower pressure column, and thus the level in the first storage vessel 142 falls.

The advantage of this embodiment of the present invention over the prior art stems from the addition of all the liquefied air directly to the higher pressure column 124. Since the higher pressure column handles any flash vapor resulting from the pressure let down across valve 134, the need for and size of vapor vents (not shown) from the first storage vessel 142 are significantly reduced from that necessary for a vessel located upstream of the higher pressure column (as in the prior art). The proper sizing of the vent lines is much more important during transient and start-up operations than for normal operations, where sub-cooling of the liquid can be used to alleviate some of the vapor produced during depressurization. Malperformance of the vent control would cause pressure or flow fluctuations in the liquid air line which in turn would affect the oxygen delivery pressure. The embodiment in FIG. 1 has an added advantage in that the first storage vessel 142 need not operate at as high a pressure as would be necessary for storage of liquid upstream of the higher pressure column, thus reducing the cost of the storage vessel.

Figure 2:
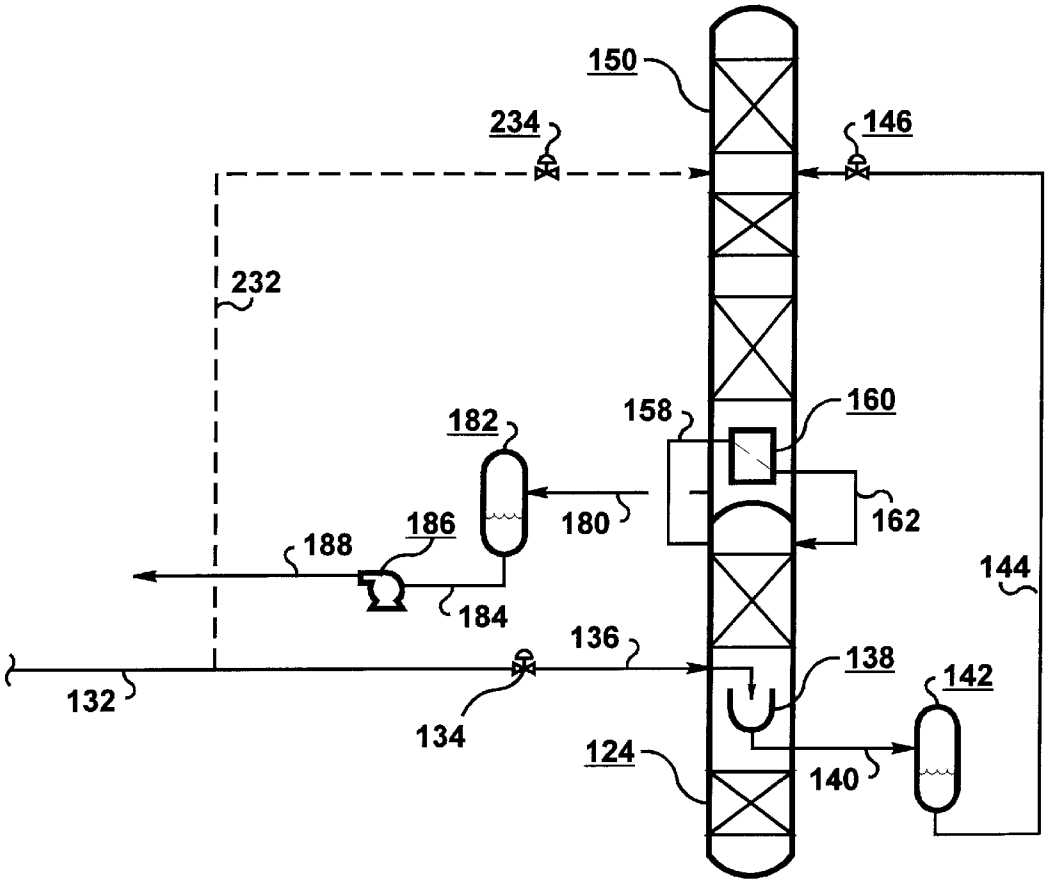
FIG. 2 is a schematic diagram of another embodiment of the present invention.

FIG. 2, simplified for clarity, illustrates another embodiment of the present invention. To minimize the volume of the first storage vessel 142, a fraction of the incoming liquid air may be split off as stream 232, which after being reduced in pressure by valve 234, may be sent directly to the lower pressure column 150. In this case, the sum of the flow rates of streams 232 and 144 remains constant.

Figure 3:
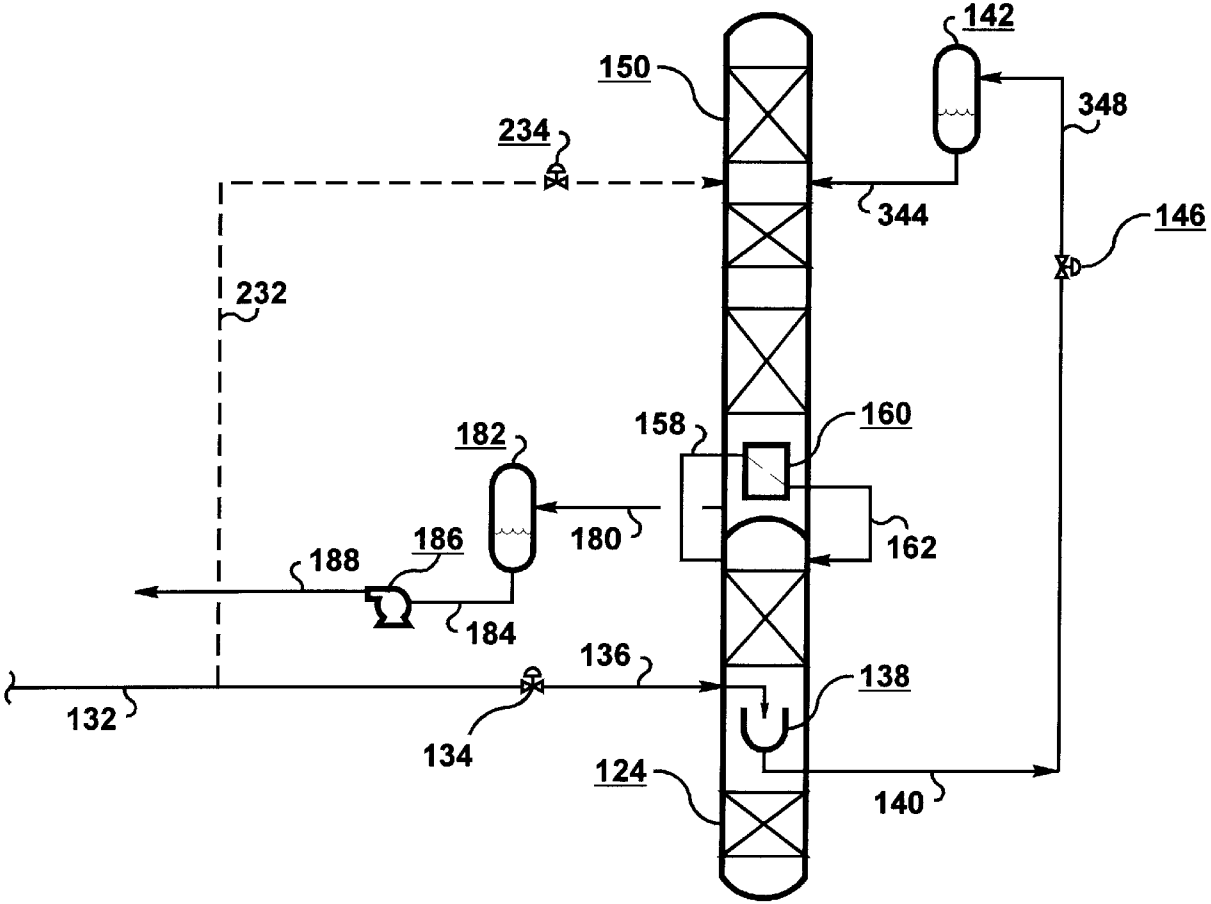
FIG. 3 is a schematic diagram of another embodiment of the present invention.

FIG. 3, simplified for clarity, illustrates another embodiment of the present invention. In this embodiment, the first storage vessel 142 is maintained at a relatively low pressure. Liquid stream 140 is withdrawn from the higher pressure column 124 and reduced in pressure across valve 146 to form stream 348, which is sent to the first storage vessel 142. Liquid stream 344 is withdraw at a constant rate from the first storage vessel and directed to the lower pressure column 150. Optionally, a fraction of the incoming liquid stream 132 may be split off as stream 232, which after being reduced in pressure by valve 234, may be sent directly to the lower pressure column. In this event, the flow of stream 344 will vary such that the sum of the flow rates of streams 344 and 232 remains constant. This embodiment has the advantage of only requiring low pressure (low cost) storage.

Figure 4:
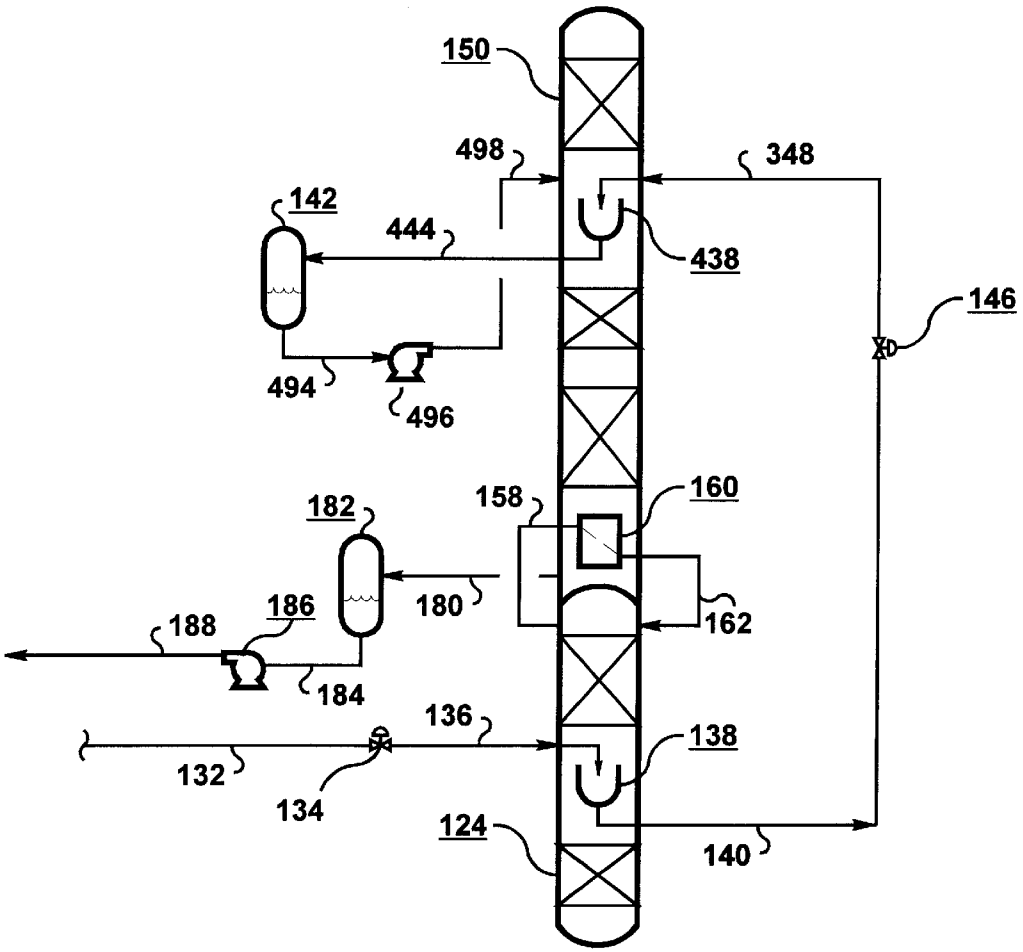
FIG. 4 is a schematic diagram of another embodiment of the present invention.

FIG. 4, simplified for clarity, illustrates another embodiment of the present invention. As in the embodiment shown in FIG. 3, the first storage vessel 142 is maintained at a relatively low pressure in the embodiment in FIG. 4. Liquid stream 140 is withdrawn from the higher pressure column 124, reduced in pressure across valve 146 to form stream 348, and sent to the lower pressure column 150. During periods of greater-than-average oxygen delivery, liquid is withdrawn from a collection pot 438 in the lower pressure column as stream 444 and directed to the first storage vessel 142. During periods of less-than-average oxygen delivery, liquid stream 494 is withdrawn from the first storage vessel 142, pumped in pump 496 to form stream 498, and delivered to the lower pressure column. This embodiment allows the first storage vessel 142 to operate at near atmospheric pressure.

Figure 5:
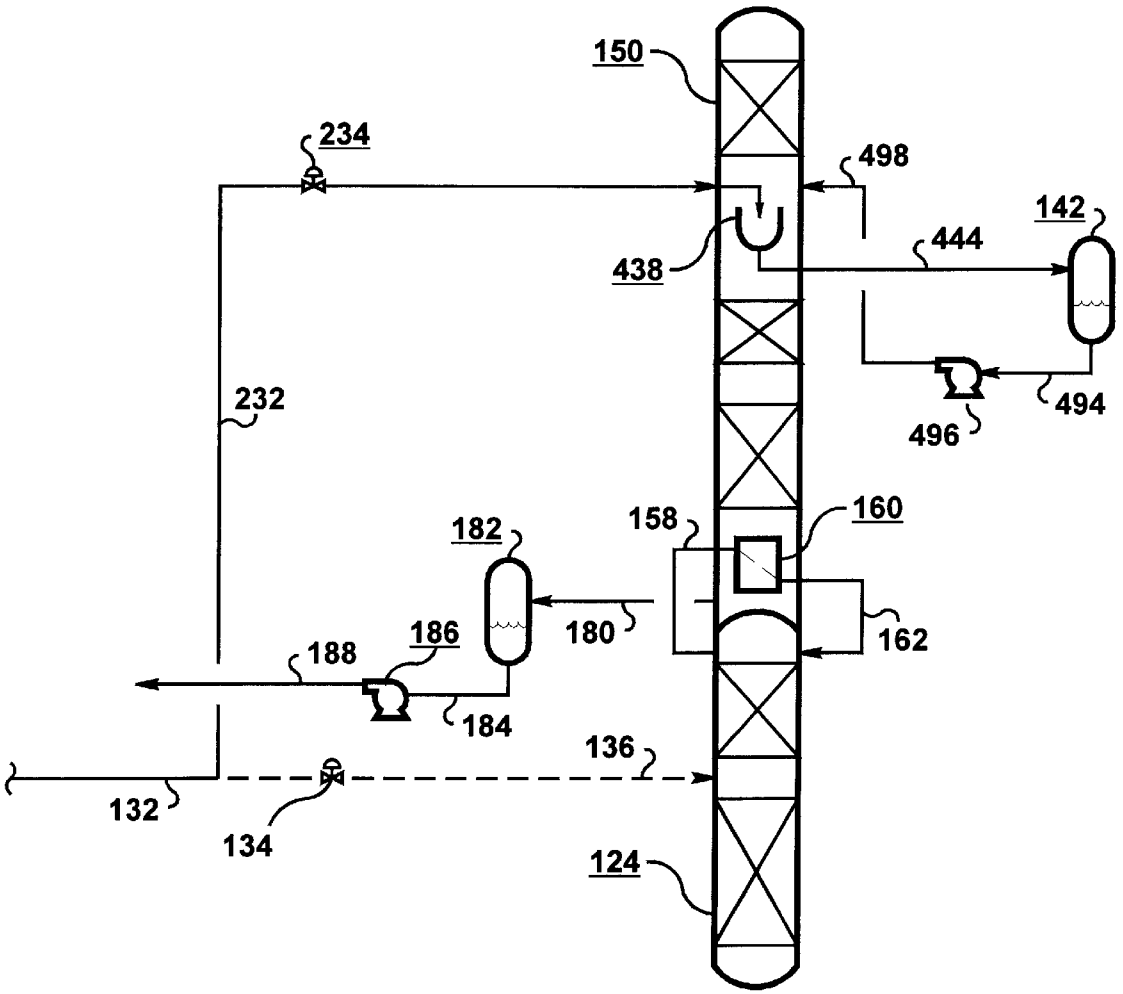
FIG. 5 is a schematic diagram of another embodiment of the present invention.

FIG. 5, simplified for clarity, illustrates another embodiment of the present invention. As in the embodiment shown in FIG. 4, the first storage vessel 142 is maintained at a pressure less than that of the lower pressure column 150 in the embodiment in FIG. 5. There is no liquid flow emanating from the liquid air feed stage of the higher pressure column 124 to that of the lower pressure column, and the majority of the liquid air flow to the distillation column system travels through line 232. In one useful extreme, there would be no liquid air flow going to the higher pressure column (i.e., stream 136 has zero flow). This embodiment is useful for small plants which cannot justify the cost of multiple air feeds. The remainder of the embodiment in FIG. 5 is similar to that of FIG. 4. During periods of greater-than-average oxygen delivery, liquid is withdrawn from a collection pot 438 in the lower pressure column as stream 444 and directed to the first storage vessel 142. During periods of less-than-average oxygen delivery, liquid stream 494 is withdrawn from the first storage vessel 142, pumped in pump 496 to form stream 498, and delivered to the lower pressure column. The embodiment shown in FIG. 5 also may be extended to single column systems that do not have a higher pressure column.

Figure 6:
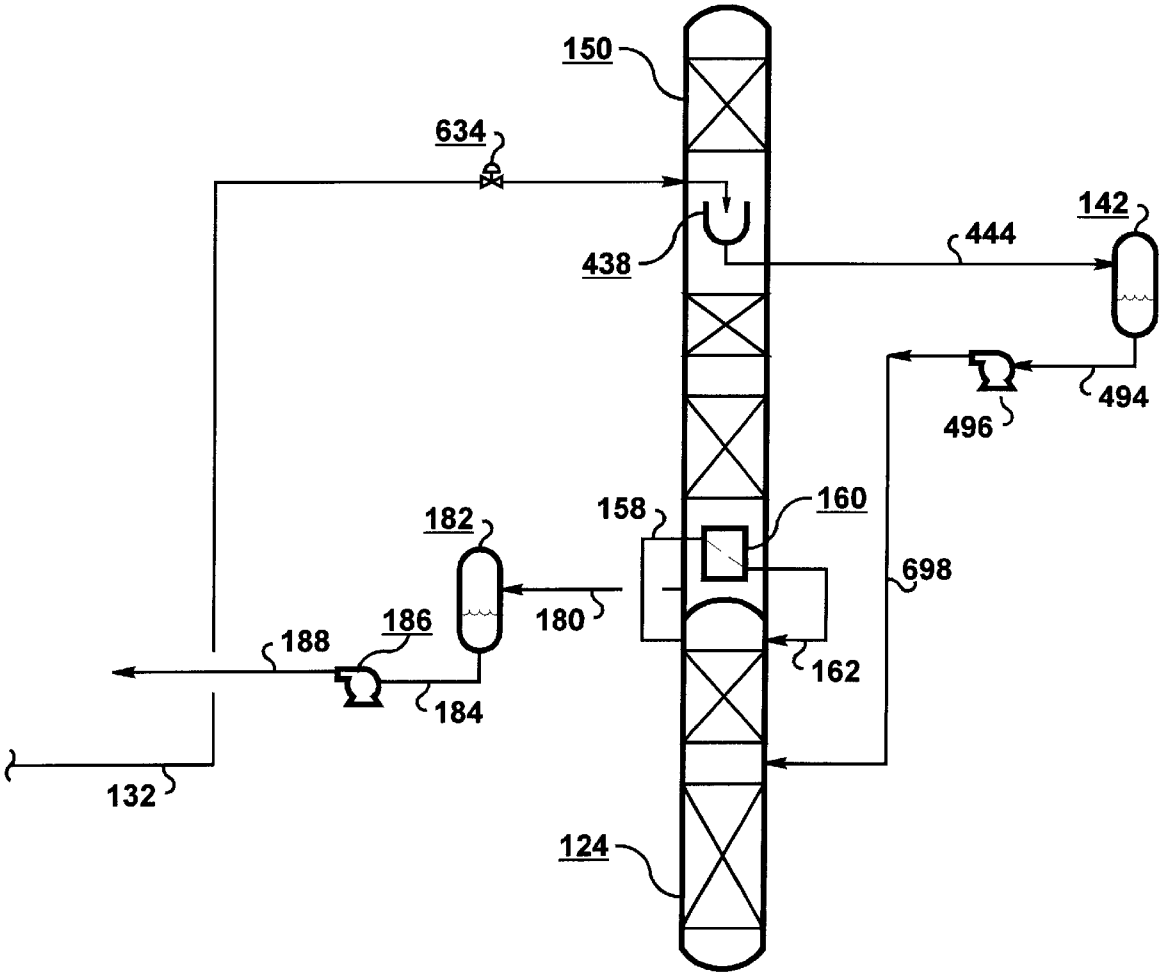
FIG. 6 is a schematic diagram of another embodiment of the present invention.

FIG. 6, simplified for clarity, illustrates another embodiment of the present invention. This embodiment differs from that of FIG. 5 in two ways. First, all of the liquid air stream 132, after being reduced in pressure by valve 634, is fed to the lower pressure column 150 (rather than some being fed to the higher pressure column 124). Second, the liquid stream 698 returned from the first storage vessel 142 is directed to the higher pressure column 124 (in contrast to stream 498 being directed to the lower pressure column in FIG. 5).

In all of the embodiments described, all of the liquid oxygen produced from the distillation column system is sent to the second storage vessel 182 operating at essentially the pressure of the lower pressure column 150, and the oxygen is withdrawn from storage and pumped to delivery pressure.

Other options include: 1) pumping the liquid oxygen from the lower pressure column and directing the liquid oxygen to a high pressure storage; 2) splitting the flow of liquid oxygen from the lower pressure column and passing only the excess liquid oxygen production to the second storage vessel during periods of less-than-average oxygen delivery; and 3) pumping all of the liquid oxygen from the lower pressure column to delivery pressure, then splitting the flow as in option 2).

For clarity, the various embodiments of the present invention were described without any consideration for nitrogen coproduction. However, persons skilled in the art will recognize that the embodiments are applicable even if nitrogen product is produced from the top of the lower pressure column 150, the top of the higher pressure column 124, or both. For the case where nitrogen is produced from the top of the higher pressure column, nitrogen may be withdrawn as either a vapor or a liquid. If withdrawn as a vapor, the nitrogen is warmed in the main heat exchanger 112 and compressed, if necessary, to delivery pressure.

Figure 7:
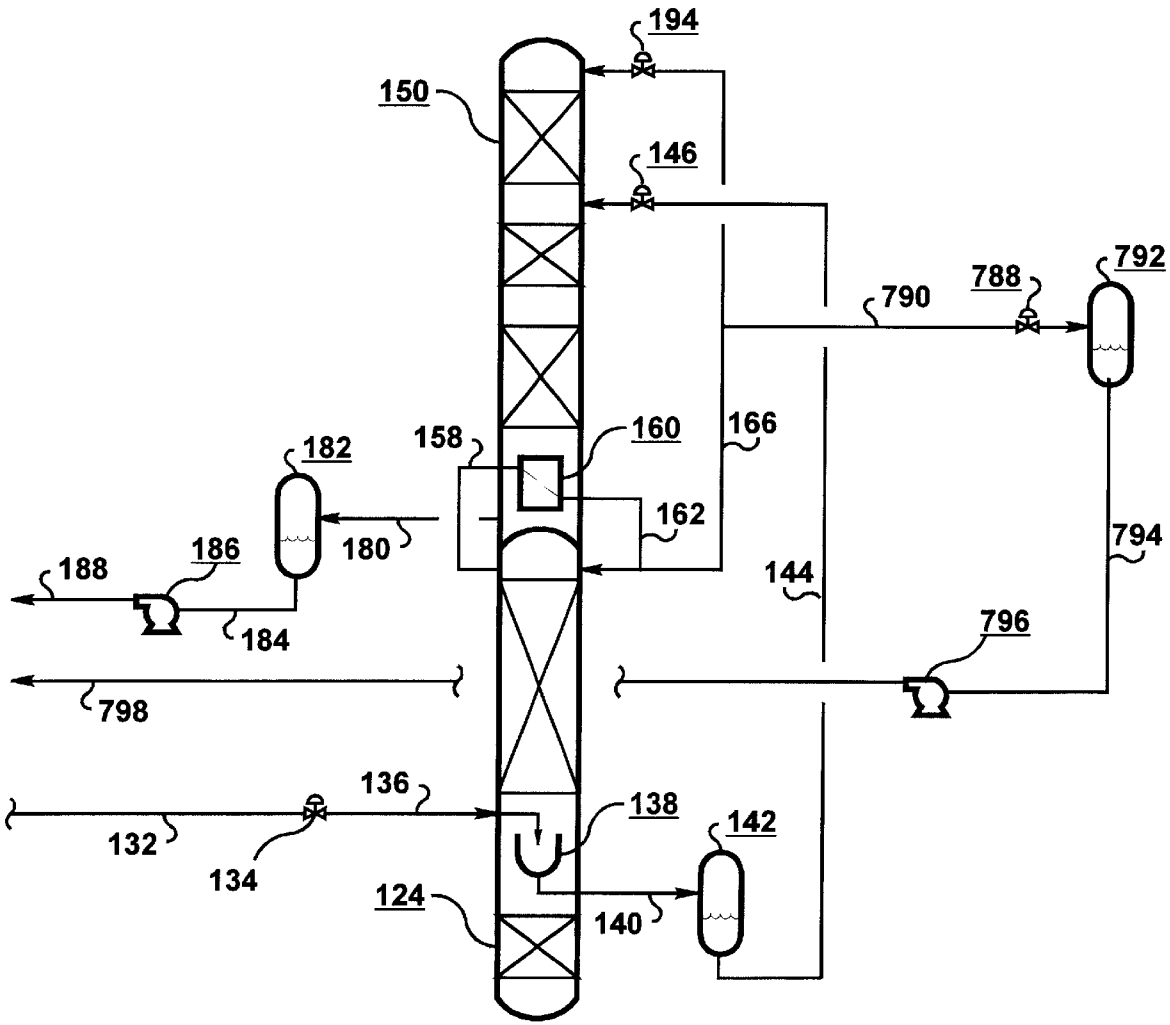
FIG. 7 is a schematic diagram of another embodiment of the present invention.

If the nitrogen coproduct is withdraw as a liquid, the nitrogen may be pumped to delivery pressure then vaporized against additional incoming air. In such an event, it is possible to handle variable nitrogen production rates by utilizing a third storage vessel 792 for liquid nitrogen, as illustrated in FIG. 7. A portion of the liquid nitrogen stream 166 withdrawn from the higher pressure column 124 may be fed, after being reduced in pressure by valve 788, to the third storage vessel 792 as stream 790. Liquid nitrogen is removed subsequently from the third storage vessel as stream 794, pumped to the desired delivery pressure in pump 796 to form stream 798, then vaporized in the main heat exchanger 112 (not shown in FIG. 7). As with variable oxygen production, the level in the third storage vessel 792 rises during periods of lower-than-average nitrogen delivery, and the level will fall during periods of greater-than-average nitrogen delivery. The nitrogen storage vessel may operate at any pressure desired. Optionally, the liquid nitrogen stream 166 may be cooled before stream 790 is removed.

For example, the embodiment of FIG. 1 was described with refrigeration being provided by turbo expansion of a portion of the air fed to the lower pressure column 150. Persons skilled in the art will recognize that the present invention also is applicable using any other known refrigeration techniques, such as: 1) expansion of all or a portion of the air to the higher pressure column; 2) expansion of a nitrogen-enriched vapor from either the higher pressure column or the lower pressure column; and 3) injection of cryogenic liquid.

In addition, persons skilled in the art will recognize that the embodiments of the present invention also are applicable when argon and/or other liquid products are coproduced.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A process for delivering oxygen at a variable flow rate, said process having an average oxygen delivery rate and using a distillation system having at least a first distillation column operating at a first pressure and a second distillation column operating at a second pressure, wherein each distillation column has a top and a bottom, comprising the steps of:

feeding a stream of liquid comprising air components into the first distillation column, wherein at least a portion of said stream of liquid mixes with a liquid descending in the first distillation column, thereby forming a liquid mixture;

transferring at least a portion of the liquid mixture from a location above the bottom of the first distillation column to a first storage vessel at least during periods of greater than the average oxygen delivery rate;

withdrawing a stream of liquid oxygen from the distillation system;

transferring at least a portion of the withdrawn stream of liquid oxygen to a second storage vessel at least during periods of less than the average oxygen delivery rate; and removing at least a portion of the liquid oxygen from the second storage vessel at least during periods of greater than the average oxygen delivery rate.

2. A process as in claim 1, wherein:

the stream of liquid oxygen is withdrawn at a substantially constant flow rate from one of the first or second distillation columns; and the at least a portion of the liquid oxygen is removed at a variable flow rate from the second storage vessel.

3. A process as in claim 1, wherein at least a portion of the liquid mixture transferred from the first distillation column is withdrawn at substantially the same location within the first distillation column where the stream of liquid is fed into the first distillation column.

4. A process as in claim 1, further comprising the steps of:

increasing the pressure of the at least a portion of the liquid oxygen removed from the second storage vessel; and vaporizing the at least a portion of the liquid oxygen having an increased pressure to form a gaseous oxygen product stream.

5. A process as in claim 1, wherein the first pressure is higher than the second pressure.

6. A process as in claim 1, wherein the first pressure is lower than the second pressure.

7. A process as in claim 1, wherein the stream of liquid comprising air components has the composition of air.

8. A process as in claim 1, comprising the further steps of:

withdrawing a stream of liquid nitrogen from the first distillation column;

transferring at least a portion of the stream of liquid nitrogen to a third storage vessel; and withdrawing at least a portion of the liquid nitrogen from the third storage vessel.

9. A process as in claim 8, wherein:

the stream of liquid nitrogen is withdrawn at a substantially constant flow rate from the first distillation column; and the at least a portion of the liquid nitrogen is withdrawn at a variable flow rate from the third storage vessel.

10. A process as in claim 9, further comprising the steps of:

increasing the pressure of the at least a portion of the liquid nitrogen removed from the third storage vessel;

vaporizing the at least a portion of the liquid nitrogen having an increased pressure to form a gaseous nitrogen product stream.

11. A cryogenic air separation unit using a process as in claim 8.

12. A cryogenic air separation unit using a process as in claim 1.

13. A process for delivering oxygen at a variable flow rate, said process having an average oxygen delivery rate and using a distillation system having at least a first distillation column operating at a first pressure and a second distillation column operating at a second pressure lower than the first pressure, wherein each distillation column has a top and a bottom, comprising the steps of:

feeding a first stream of liquid air into the first distillation column, wherein at least a portion of said first stream of liquid air mixes with a liquid descending in the first distillation column, thereby forming a liquid mixture;

feeding a second stream of liquid air into the second distillation column;

transferring at least a portion of the liquid mixture from a location above the bottom of the first distillation column to a first storage vessel at least during periods of greater than the average oxygen delivery rate;

withdrawing a stream of liquid oxygen from the distillation system;

transferring at least a portion of the withdrawn stream of liquid oxygen to a second storage vessel at least during periods of less than the average oxygen delivery rate; and removing at least a portion of the liquid oxygen from the second storage vessel at least during periods of greater than the average oxygen delivery rate.

14. A process as in claim 13, wherein:

the second stream of liquid air is fed into the second distillation column at a first variable flow rate;

the at least a portion of the liquid mixture is fed from the first storage vessel into the second distillation column at a second variable flow rate; and a sum of the first variable flow rate and the second variable flow rate remains substantially constant over time.

15. A process for delivering oxygen at a variable flow rate, said process having an average oxygen delivery rate and using a distillation system having at least a first distillation column operating at a first pressure and a second distillation column operating at a second pressure higher than the first pressure, wherein each distillation column has a top and a bottom, comprising the steps of:

feeding a stream of liquid air into the second distillation column, wherein at least a portion of said stream of liquid air mixes with a first liquid descending in the second distillation column, thereby forming a first liquid mixture;

transferring at least a portion of the first liquid mixture from the second distillation column to the first distillation column, wherein at least a portion of said first liquid mixture mixes with a second liquid descending in the first distillation column, thereby forming a second liquid mixture;

transferring at least a portion of the second liquid mixture from a location above the bottom of the first distillation column to a first storage vessel at least during periods of greater than the average oxygen delivery rate;

withdrawing a stream of liquid oxygen from the distillation system;

transferring at least a portion of the withdrawn stream of liquid oxygen to a second storage vessel at least during periods of less than the average oxygen delivery rate; and removing at least a portion of the liquid oxygen from the second storage vessel at least during periods of greater than the average oxygen delivery rate.

16. A process for delivering oxygen at a variable flow rate, said process having an average oxygen delivery rate and using a distillation system having at least a first distillation column operating at a first pressure and a second distillation column operating at a second pressure higher than the first pressure, wherein each distillation column has a top and a bottom, comprising the steps of:

feeding a stream of liquid air into the first distillation column, wherein at least a portion of said stream of liquid air mixes with a liquid descending in the first distillation column, thereby forming a liquid mixture;

feeding a second stream of liquid air into the second distillation column;

transferring at least a portion of the liquid mixture from a location above the bottom of the first distillation column to a first storage vessel at least during periods of greater than the average oxygen delivery rate;

withdrawing a stream of liquid oxygen from the distillation system;

transferring at least a portion of the withdrawn stream of liquid oxygen to a second storage vessel at least during periods of less than the average oxygen delivery rate; and removing at least a portion of the liquid oxygen from the second storage vessel at least during periods of greater than the average oxygen delivery rate.

17. A process for delivering oxygen at a variable flow rate, said process having an average oxygen delivery rate and using a distillation system having at least a first distillation column operating at a first pressure and a second distillation column operating at a second pressure higher than the first pressure, wherein each distillation column has a top and a bottom, comprising the steps of:

feeding a stream of liquid air into the first distillation column, wherein at least a portion of said stream of liquid air mixes with a liquid descending in the first distillation column, thereby forming a liquid mixture;

transferring at least a portion of the liquid mixture from a location above the bottom of the first distillation column to a first storage vessel at least during periods of greater than the average oxygen delivery rate;

withdrawing the at least a portion of the liquid mixture from the first storage vessel;

transferring the at least a portion of the liquid mixture withdrawn from the first storage vessel into the second distillation column at a substantially constant flow rate;

withdrawing a stream of liquid oxygen from the distillation system;

transferring at least a portion of the withdrawn stream of liquid oxygen to a second storage vessel at least during periods of less than the average oxygen delivery rate; and removing at least a portion of the liquid oxygen from the second storage vessel at least during periods of greater than the average oxygen delivery rate.

* * * * *